US007449074B2

(12) United States Patent
Branagan

(10) Patent No.: US 7,449,074 B2
(45) Date of Patent: Nov. 11, 2008

(54) PROCESS FOR FORMING A NANO-CRYSTALLINE STEEL SHEET

(75) Inventor: Daniel James Branagan, Idaho Falls, ID (US)

(73) Assignee: The Nano Company, Inc., Providence, RI (US)

( * ) Notice: Subject to any disclaimer, the term of this patent is extended or adjusted under 35 U.S.C. 154(b) by 0 days.

(21) Appl. No.: 11/117,649

(22) Filed: Apr. 28, 2005

(65) Prior Publication Data

US 2005/0252586 A1 Nov. 17, 2005

Related U.S. Application Data

(60) Provisional application No. 60/566,165, filed on Apr. 28, 2004.

(51) Int. Cl.
*C21D 9/00* (2006.01)
*C22C 38/32* (2006.01)

(52) U.S. Cl. ..... 148/561; 148/541; 148/661; 148/403

(58) Field of Classification Search ..... 148/533–542, 148/578, 637, 660–661, 325, 403, 561, 638
See application file for complete search history.

(56) References Cited

U.S. PATENT DOCUMENTS

| | | | | |
|---|---|---|---|---|
| 4,297,135 | A * | 10/1981 | Giessen et al. | 148/321 |
| 5,030,296 | A * | 7/1991 | Ueda et al. | 148/541 |
| 5,340,413 | A * | 8/1994 | Martis | 148/305 |
| 6,168,673 | B1 * | 1/2001 | Kanekiyo et al. | 148/122 |
| 6,329,894 | B1 * | 12/2001 | Kanekiyo et al. | 335/302 |
| 6,568,462 | B1 * | 5/2003 | Barteri et al. | 164/480 |
| 6,596,101 | B2 * | 7/2003 | Weihs et al. | 148/442 |
| 6,679,313 | B2 | 1/2004 | Poirier et al. | 164/428 |
| 2004/0051614 | A1 | 3/2004 | Kanekiyo | |

FOREIGN PATENT DOCUMENTS

| | | | |
|---|---|---|---|
| EP | 1014393 | | 6/2000 |
| EP | 1452617 | | 9/2004 |
| JP | 63-115657 | * | 5/1988 |
| JP | 63115657 | | 5/1988 |
| JP | 2-133522 | * | 5/1990 |
| JP | 402133522 | | 5/1990 |

OTHER PUBLICATIONS

International Search Report with Written Opinion dated Oct. 16, 2006 received in corresponding International Patent Application Serial No. PCT/US05/14423 (9 pages).
EPO Search Report issued in related EP Patent Application No. 05779799.5 dated Apr. 7, 2008. (3 pages).
Chinese Office Action recieved in related Chinese Patent Application No. 2005800191440 dated Jul. 18, 2008 (6 pages).

* cited by examiner

*Primary Examiner*—Deborah Yee
(74) *Attorney, Agent, or Firm*—Grossman, Tucker, Perreault & Pfleger, PLLC

(57) ABSTRACT

A nano-crystalline steel sheet and a method of making a nano-crystalline steel sheet are provided. The nano-crystalline steel sheet may be produced by supplying a liquid metallic glass forming alloy to counter-rotating casting rolls. The liquid alloy may form partially solidified layers on each of the casting rolls. The partially solidified layers may then be pressed together by the counter-rotating casting rolls to form a sheet. The twin casting roll method may provide a sufficiently high cooling rate during solidification of the alloy to create a nano-crystalline microstructure.

9 Claims, 1 Drawing Sheet

PROCESS FOR FORMING A NANO-CRYSTALLINE STEEL SHEET

CROSS REFERENCE TO RELATED APPLICATIONS

This application claims priority to U.S. Provisional Application No. 60/566,165 filed Apr. 28, 2004.

FIELD OF INVENTION

The present invention relates generally to metallic glasses, and more particularly to a metallic glass sheet material and methods for forming the same. Specifically, a method of producing a metallic glass sheet is disclosed in which a molten metallic glass forming alloy is formed into a sheet material.

BACKGROUND

It has been known for at least 30 years, since the discovery of Metglasses (iron based glass forming compositions used for transformer core applications) that iron based alloys could be made to be metallic glasses. However, with few exceptions, these iron based glassy alloys have had very poor glass forming ability and the amorphous state could only be produced at very high cooling rates (>$10^6$ K/s). Thus, these alloys may only be processed by techniques which give very rapid cooling such as drop impact or melt-spinning techniques.

While conventional steels have critical cooling rates for forming metallic glasses in the range of $10^9$ K/s, special iron based metallic glass forming alloys have been developed having a critical cooling rate orders of magnitude lower than conventional steels. Some special alloys have been developed that may produce metallic glasses at cooling rates in the range of $10^4$ to $10^5$ K/s. Furthermore, some bulk glass forming alloys have critical cooling rates in the range of $10^0$ to $10^2$ K/s, however these alloys may employ rare or toxic alloying elements to increase glass forming ability, such as the addition of beryllium, which is highly toxic, or gallium, which is expensive. The development of glass forming alloys which are low cost and environmentally friendly has proven much more difficult.

In addition to the difficultly in developing cost effective and environmentally friendly alloys, the very high cooling rate required to produce metallic glass has limited the manufacturing techniques that are available for producing articles from metallic glass. The limited manufacturing techniques available have in turn limited the products that may be formed from metallic glasses, and the applications in which metal glasses may be used. Conventional techniques for processing steels from a molten state generally provide cooling rates on the order of $10^{-2}$ to $10^0$ K/s. Special alloys that are more susceptible to forming metallic glasses, i.e., having reduced critical cooling rates on the order of $10^4$ to $10^5$ K/s, may not be processed using conventional techniques with such slow cooling rates and still produce metallic glasses. Even bulk glass forming alloys having critical cooling rates in the range of $10^0$ to $10^2$ K/s, are limited in the available processing techniques, and have the additional processing disadvantage in that they generally may not be processed in air but only under very high vacuum.

Common processing techniques used with metal glasses generally involve thermal spray coating. In a thermal spray coating process an atomized spray of molten metal may cool to a solid very quickly, exhibiting cooling rates in the range of $10^4$ to $10^5$ K/s. This rapid initial cooling facilitates the formation of a metallic glass structure. However, even while thermal spray coating may achieve a cooling rate sufficient to form metallic glass coatings, the rate of application of the coatings, as well as the coating thickness, may be limited by the need for secondary cooling of the solidified deposit down to room temperature. Secondary cooling may occur at much slower rate, typically in the range of 50 to 200 K/s. If a coating is too thick or the coating is built up too quickly, the thermal mass of the coating may cause devitrification, and the metallic glass coating may begin to crystallize.

Three methods that have been examined for producing an amorphous, or metallic glass, steel sheet or plate are spray forming, spray rolling, and planar flow casting followed by consolidation. Spray forming, such as spray casting, including the so-called Osprey process, involves depositing atomized liquid metal onto a substrate which collects and solidifies the droplets of the liquid metal. This method may be analogized to producing a thick cross-section by thermal spray coating.

Spray rolling is a method that is somewhat related to spray casting. Spray forming or casting may generally involve depositing atomized liquid metal on a substrate having a shape corresponding to the desired shape of the cast article. In the process of spray rolling, rather than spraying an atomized liquid metal onto a substrate, the atomized liquid metal may be sprayed onto two rollers. The rollers may compress the sprayed droplets to reduce the porosity of the accumulated droplets. Spray rolling may, therefore, produce a less porous and denser sheet than spray casting.

The third common method for producing sheets of steel metallic glass is planar flow cast ribbon consolidation. According to this method, thin ribbons of metallic glass may be produced using a planar flow method. Several thin ribbons may be stacked on top of one another to achieve a desired sheet or plate thickness. While the stacked metal ribbons are still in a heated condition they may be consolidated into a single sheet or plate by warm rolling. This process has generally been applied to minimize eddy current losses in amorphous transformer core alloys and has not been examined as a route to develop mechanical properties.

SUMMARY

According to one aspect, the present invention provides a process for selecting a metal alloy suitable for forming a nano-crystalline steel sheet. The process may include the use of two casting rolls, the rolls having a gap therebetween, and supplying a liquid metallic glass forming alloy to the casting rolls proximate to the gap. The process may further include forming a sheet by rotating the casting rolls in opposite directions and cooling the liquid metallic glass forming alloy to produce a nano-crystalline microstructure.

According to another aspect, the present invention provides a sheet including an iron based alloy present as a continuous structure across a thickness of the sheet, wherein the sheet has a crystalline grain size less than about 100 microns.

According to another aspect, the present invention is directed at selecting a metallic glass forming alloy having a critical cooling rate, viscosity, oxidation resistance, and relatively low melt reactivity suitable for processing into a nano-crystalline steel sheet, via strip casting methodology.

BRIEF DESCRIPTION OF THE DRAWINGS

Features and advantages of the present invention are set forth herein by description of embodiments consistent with the present invention, which description should be considered in conjunction with the accompanying drawings, wherein.

DETAILED DESCRIPTION OF PREFERRED EMBODIMENTS

Figure 1:
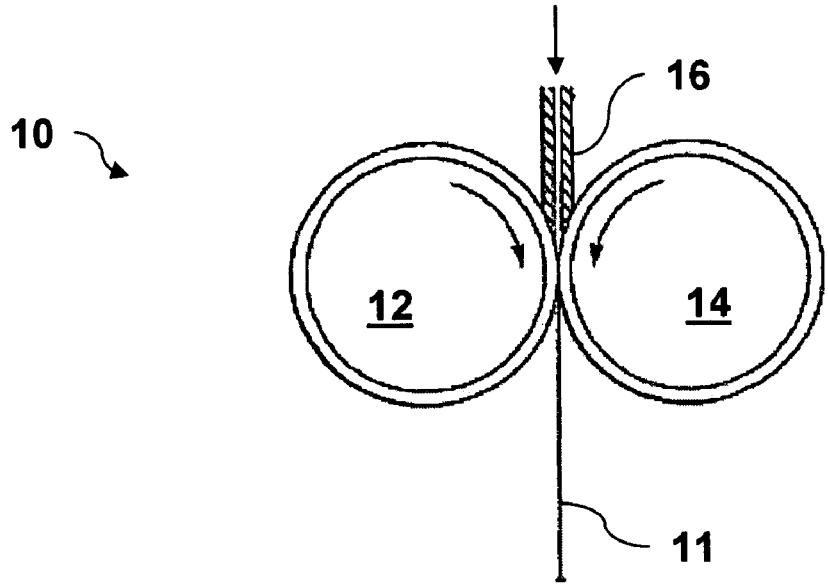
FIG. 1 is a schematic drawing of an apparatus that may be used to form nano-crystalline steel sheet consistent with the present invention.

The present invention is directed at the formation of a nano-crystalline steel sheet material and a method for producing the same. As used in any embodiment herein the terms metallic glass, nano-crystalline and amorphous metallic material all generally refer to a metallic material having a microstructure with a crystalline grain less than about 200 microns, preferably with a crystalline grain size less than about 100 microns, and more preferably with a crystalline grain size less than about 1 micron.

Consistent with the present invention, the nano-crystalline materials may be iron based alloys, such as those marketed under the name Superhard Steel Alloys™, available from The Nanosteel™ Company as well as a derivative of such a metallic glass-forming, iron alloy. It will be appreciated that the present invention may suitably employ other alloys based on iron, or other metals, that are susceptible to forming metallic glass materials at critical cooling rates less than about $10^5$ K/s. Accordingly, an exemplary alloy may include a steel composition, comprising at least 50% iron and at least one element selected from the group consisting of Ti, Zr, Hf, V, Nb, Ta, Cr, Mo, W, Al, and the class of elements called rare earths including Y, Sc, La, Ce, Pr, Nd, Sm, Eu, Gd, Tb, Dy, Ho, Er, Tm, Yb and Lu; and at least one element selected from the group consisting of B, C, N, O, P and S. In such regard, alloys of the present invention comprise up to about 15 elements, and all numerical permutations of alloys therebetween (e.g., alloys of up to about 14 elements, up to about 13 elements, or alloys between 4-15 elements, 5-14 elements, etc.).

Along such lines, it should be appreciated that the above reference to the preferred number of alloy forming elements clearly establishes that the presence of additional elements that do not form or contribute to the alloy forming materials herein, while tolerable and anticipated, do not depart from the basic character of this invention. In other words, the invention herein recognizes that the presence of other elements in concentrations at or below about 1% wt (10,000 ppm) would not be considered to be part of the principal alloys of the present invention, which as noted, may comprise up to about 15 or fewer elements.

In addition, it is worth noting that in particular preferred embodiment, the alloys of the present invention may comprise four to six elements in their compositions. Among such elements are iron, chromium (which can be included for corrosion resistance), boron, carbon, and/or phosphorous which can be included to lower the melting point and aid glass formation. Accordingly, the particular temperature for devitrifying the metal glass may be varied depending upon the particular alloy used, and a particular processing method for forming the steel sheet. Furthermore, one or both of molybdenum and tungsten can be included to control hardness and improve corrosion resistance in specific environments.

Consistent with the present invention, a nano-crystalline steel sheet may be formed using a two-roll casting process. The two roll process herein may allow nano-crystalline steel to be formed as a smooth, continuous ribbon having a desired thickness. The two roll process may produce sheets having a thickness in the range of about 0.4 to 10 mm, and therefore may not require subsequent rolling to produce sheet. The nano-crystalline steel sheet produced according to the present invention may subsequently be processed using conventional sheet processing techniques that do not heat the sheet above the crystallization temperature.

Figure 2:
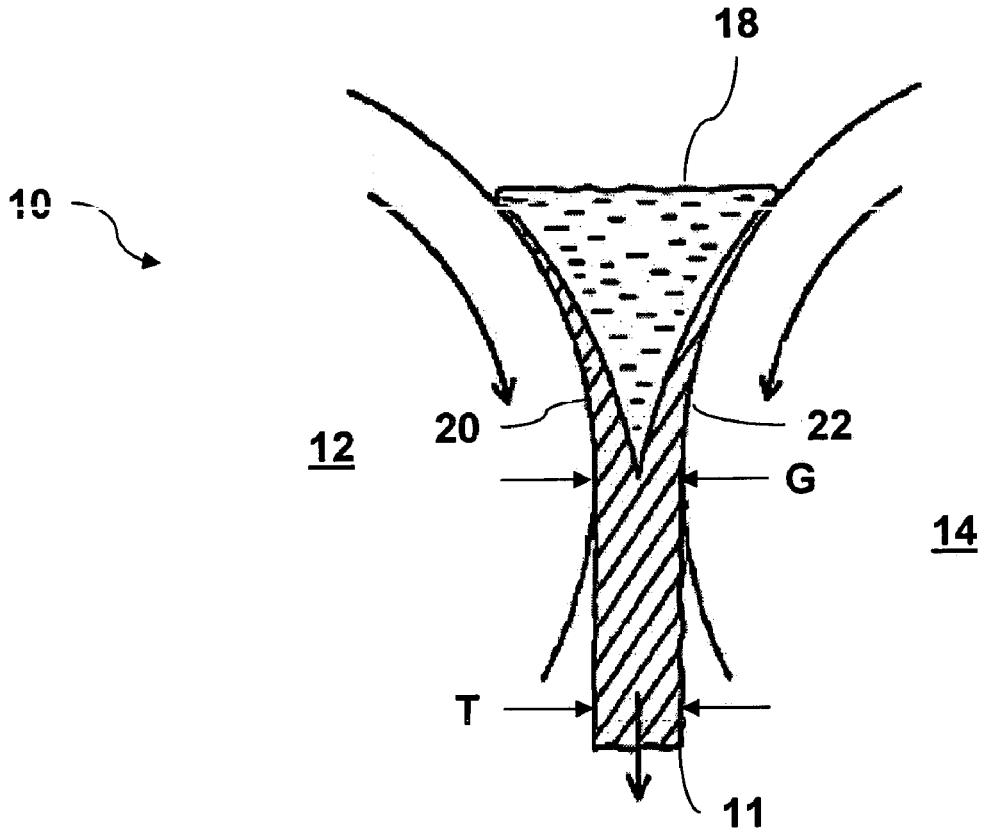
FIG. 2 is an enlarged schematic view of the intersection of the rolls for the apparatus shown in FIG. 1.

Turning to FIGS. 1 and 2, an exemplary system 10 for producing a nano-crystalline steel sheet 11 consistent with the present invention is shown. The apparatus 10 may generally include two counter-rotating rolls 12, 14. The counter-rotating rolls may be separated by a gap G that may generally correspond to the desired thickness T of the sheet 11. It should be recognized that, while controlling the gap G may be used to control the thickness T of the sheet 11, the gap G between the rolls 12, 14 may not necessarily be the same as the thickness T of the sheet 11. The apparatus 10 may also include a nozzle 16, or other delivery device, for supplying molten, or liquid, nano-crystalline forming alloy to the counter-rotating rolls 12, 14.

The molten alloy may be allowed to accumulate between the casting rolls 12, 14, thereby forming a bead or puddle of the liquid alloy 18. A partially solidified layer of the alloy 20, 22 may form on the respective casting rolls 12, 14. As the two casting rolls 12, 14 rotate the layers of alloy 20, 22 formed on each casting roll 12, 14 may be pressed together and passed through the gap G between the rolls. Pressing the partially solidified layers 20, 22 between the casting rolls 12, 14 may cause the partially solidified layers to merge together and may produce a single sheet 11 of nano-crystalline steel.

The accumulation of alloy between the casting rolls 12, 14, i.e. the size of the bead 18, may be controlled to ensure that an adequate quantity of alloy is present between the casting rolls 12, 14 to allow the continual formation of the nano-crystalline sheet 11. The size of the bead 18 may influence the formation and thickness of the partially solidified layers 20, 22 of the alloy formed on each of the casting rolls 12, 14. For example, the bead 18 may provide a sufficient thermal mass to influence the rate of cooling of the partially solidified layers 20, 22. The size of the bead 18 may, therefore, be varied to control the thickness and degree of solidification of the partially solidified layers 20, 22. The thickness and degree of solidification of the partially solidified layers may also be influenced by throughput of the casting rolls 12, 14, rotational speed of the casting rolls 12, 14, and by the location of the liquid alloy as it is directed by the nozzle 16.

Consistent with the present invention, the cooling rate of the alloy from a liquid to a solid may be on the order of $10^4$ K/s. According to one specific embodiment, the cooling rate of the alloy during solidification may be approximately 12,000 K/s. Accordingly, the alloy may solidify before significant growth of crystalline domains, thereby producing a nano-crystalline microstructure.

The exact cooling rate during solidification may be influenced by a number of factors, such as rate of rotation of the casting rolls 12, 14, the material from which the casting rolls 12, 14 are formed, the use of additional cooling, etc. In one embodiment, the twin casting rolls 12, 14 may be provided. In another embodiment, the twin casting rolls may be formed from a copper alloy material. Copper alloy may provide a relatively high thermal conductivity and may increase the cooling rate of the steel sheet being formed. The cooling rate provided by copper alloy casting rolls 12, 14 may be sufficient to solidify the alloy in a nano-crystalline or glass state. It should be understood, however, that suitable casting rolls may be formed from materials other than a copper alloy, and still provide a sufficient cooling rate.

Additional cooling may be provided either by chilling the casting rolls 12, 14 or by providing a cooling medium on the exit side of the casting rolls 12, 14. For example, a cooling spray of water etc. may be applied to the sheet 11 as it exits the gap G between the casting rolls 12, 14. It should be noted that the present method may provide a high cooling rate during solidification, which is one critical cooling time. However, once the strip has solidified and passed from the casting rolls 12, 14, the cooling rate may slow greatly, for example to on the order of about 1700 C/s. However, this lower cooling rate is post solidification, that is, after the microstructure of the nano-crystalline steel sheet may generally be fixed. Optionally, additional cooling may be provided after the sheet 11 has passed from the casting rolls 12, 14 to increase the post solidification cooling rate. For example, a cooling bath or water mist cooling, etc. may be employed to increase the cooling rate.

The lower cooling rate observed after the sheet 11 has solidified may actually be beneficial in some instances. For example, the lower cooling rate may enhance the malleability of the sheet 11, making it more susceptible to secondary forming or processing operations. In this regard, the sheet 11 may undergo a secondary rolling process to further reduce, or control, the thickness of the sheet.

Nano-crystalline steel alloys suitable for use with the present invention, may exhibit a variety of physical and/or mechanical characteristics that may facilitate sheet forming consistent with the present invention. For example, nano-crystalline forming steel alloys may have a low melt viscosity, as compared with conventional steel alloys. While conventional metal alloys exhibit liquid viscosities in the melt in the range of 1.5 to 5 mPa-s, glass forming iron based alloys herein may generally exhibit a liquid viscosity range below about 1.5 mPa-s. A comparatively low melt viscosity may allow the nano-crystalline steel to be pressed into a thin sheet at a lower applied force from the twin casting rolls. Accordingly, thin sheets of nano-crystalline steel may be formed consistent with the present invention. A lower melt viscosity may also facilitate supplying the nano-crystalline alloy to the twin casting rolls and distributing the alloy between the rolls and across the width of the rolls.

In addition to the relatively low melt viscosity, nano-crystalline steel alloys may have a melting temperature that is lower than some conventional steel alloys, i.e., from approximately 950° C. to 1350° C. including all increments therebetween. The lower melting temperature of some suitable nano-crystalline alloys may simplify the production of nano-crystalline steel sheet. The lower temperature may make the nano-crystalline steel alloy less expensive to process, and may make the alloy easier to handle because of the lower temperature of the melt.

A nano-crystalline steel sheet according to the present invention may have a generally continuous structure across the thickness of the sheet. That is, the sheet herein is not an aggregation of discrete particles or layers. Desirably, the nano-crystalline steel sheet may generally have a crystalline grain less than about 100 microns, and more preferably a crystalline grain size less than about 1 micron.

The metallic glass sheet material according to the present invention may provide high tensile strength relative to conventional sheet steel materials. In exemplary embodiments, the tensile strength of the nano-crystalline steel sheet may be in the range of between about 250 ksi (1.72 GPa) and 1000 ksi (6.89 GPa). It is noted that the upper range of tensile strengths achievable by nano-crystalline steel sheets may be higher than Kevlar™ (i.e. tensile strength on the order of 3.5 GPa). While nano-crystalline steel sheet herein may exhibit a higher tensile strength than Kevlar™, Kevlar™ exhibits a higher specific strength (tensile strength/density) due to its low density (1.44 g/cm$^3$).

In addition to the very high tensile strength, nano-crystalline steel sheet exhibits exceptional strength to weight ratios as compared to conventional metal alloys. A comparison of strength to weight ratios for several conventional metallic materials is presented in Table 1.

TABLE 1

Strength To Weight Ratio of conventional alloys.

| Material | Density (g/cm3) | Tensile Strength (GPa) | Strength to Weight Ratio (cm) |
|---|---|---|---|
| 1005 Steel | 7.87 | 0.365 | 472,931 |
| Titanium | 4.50 | 0.220 | 498,528 |
| 316L stainless Steel | 8.03 | 0.485 | 615,893 |
| 304 Stainless Steel | 7.90 | 0.572 | 738,326 |
| 4340 Steel | 7.85 | 0.745 | 967,756 |
| Nickelvac C-22 | 8.02 | 0.793 | 1,008,273 |
| Haynes 25 Cobalt | 9.13 | 0.930 | 1,038,703 |
| Haynes 625 Nickel | 8.44 | 0.905 | 1,093,416 |
| Stellite 6 | 8.20 | 0.911 | 1,132,880 |
| Magnesium | 1.74 | 0.196 | 1,148,646 |
| Al 6061-T6 | 2.70 | 0.31 | 1,170,785 |
| Al 7075-T6 | 2.81 | 0.572 | 2,075,721 |
| W2 Tool Steel | 7.83 | 1.630 | 2,122,781 |
| Mg AZ80Z-T5 | 1.80 | 0.380 | 2,152,734 |
| Ti-6-Al-4V | 4.43 | 0.95 | 2,186,750 |
| A6 Tool Steel | 8.03 | 2.380 | 3,022,322 |

In Table 2, the measured strength to weigh ratios are shown for four (4) alloys consistent with the present invention, XPD18, XPD19, XPCAT, and XP7170. The 4 exemplary alloys are offered to aid in understanding the present invention and are not to be construed as limiting the scope thereof.

Note that the density was measured using the Archimedes Method with an applicable density balance and the tensile strength was measured on appropriately sized tensile specimens. For the XPCAT alloy, the tensile strength was not measured but estimated based on the hardness (i.e. $\sigma_y = H_v/3$).

TABLE 2

Properties of NanoSteel Alloys

| Property | XPD18 | XPD19 | XPCAT | XP7170 |
|---|---|---|---|---|
| Stoichiometery (atomic %) | $Fe_{63.2}Cr_{15.8}W_{2.0}B_{17.0}C_{2.0}$ | $Fe_{64.8}Cr_{16.2}W_{2.0}B_{17.0}$ | $Fe_{48.6}Mn_{1.9}Cr_{17.7}Mo_{2.3}W_{1.6}Ni_{4.0}B_{14.9}C_{6.7}Si_{2.3}$ | $Fe_{52.3}Mn_{2}Cr_{19}Mo_{2.5}W_{1.7}B_{16.0}C_{4.0}Si_{2.5}$ |
| Density (g/cm3) | 7.70 | 7.70 | 7.65 | 7.59 |

TABLE 2-continued

| Property | XPD18 | XPD19 | XPCAT | XP7170 |
|---|---|---|---|---|
| | Properties of NanoSteel Alloys | | | |
| Tensile Strength (GPa) | 4.00 | 3.16 | 6.12[a] | 4.90 |
| Glass Hardness ($kg/mm^2$) | 1124 | 1052 | — | 1299 |
| Nanocomposite Hardness[b] ($kg/mm^2$) | 1653 | 1565 | 1872[c] | 1670 |
| Strength to Weight Ratio (cm) | 5,297,227 | 4,184,809 | 8,157,730 | 6,583,148 |
| Peak Glass Crystallization Temperature (° C.) | 545 | 538 | 620 | 631 |
| Melting Point (° C.) | 1160 | 1225 | 1134 | 1170 |
| As-Crystallized Grain Size average (nm) | 75 | — | — | 25 |

[a]Note tensile strength for this sample estimated from the hardness
[b]Note hardness after heat treatment at 700° C. for 1 hr
[c]Note hardness after heat treatment at 750° C. for 1 hr The testing results of the 4 exemplary alloys demonstrate that high tensile strengths were obtained between about 3.16 to 6.12 GPa. Additionally, high hardness was obtained between about 1052 $kg/mm^2$ and 1872 $kg/mm^2$, depending on the alloy composition and the structure that is obtained (i.e. glass or nanocomposite). The strength to weigh ratio of the alloys was found to be up to 3.7 times greater than the archetypical Ti6Al4V aerospace alloy. Additionally, the nano-crystalline steel sheet material according to the present invention was superior for high strength to weight ratio applications in sheet form.

Furthermore, the melting point of the alloys studied was found to be much lower than conventional steels and varied from about 1160° C. to 1225° C. The peak crystallization temperature for the primary glass to crystallization transition was found to vary between 538° C. to 631° C. The as-crystallized grain size was found from direct TEM observation to vary from 25 to 75 nm after a short heat treatment above the crystallization temperature.

The foregoing description is provided to illustrate and explain the present invention. However, the description hereinabove should not be considered to limit the scope of the invention as set forth in the claims appended hereto.

What is claimed is:

1. A process for forming a nano-crystalline metal sheet comprising:

supplying a liquid metallic glass forming alloy, said alloy containing 1.6-2.0 atomic percent W, 48.6-64.8 atomic percent Fe, 15.8 to 19.0 atomic percent Cr, 0 to 2.5 atomic percent Mo, 14.9 to 17.0 atomic percent B, 0-6.7 atomic percent C, 0 to 2.5 atomic percent Si and 0 to 2.0 atomic percent Mn wherein said alloy will form into nano-crystalline metallic material;

providing two casting rolls, said rolls provided having a gap therebetween;

introducing said liquid metallic glass forming alloy to said casting rolls proximate said gap;

forming a sheet by rotating said casting rolls; and cooling said liquid metallic glass forming alloy at a rate on the order of $10^4$ K/s to produce a nano-crystalline microstructure, having a melting point from about 1134° C. to 1225° C.

2. The process according to claim 1 wherein said nano-crystalline microstructure comprises an average crystalline grain size less than, or equal to, about 100 microns.

3. The process according to claim 2 wherein said nano-crystalline microstructure comprises an average crystalline grain size less than, or equal to, about 1 micron.

4. The process according to claim 1 wherein forming a sheet comprises forming an at least partially solidified layer of alloy on each of said casting rolls and pressing said at least partially solidified layers together.

5. The process according to claim 1 wherein said casting rolls comprise a copper alloy.

6. The process according to claim 1 wherein supplying said alloy comprises forming a bead of said alloy between said casting rolls.

7. The process according to claim 1 wherein said nano-crystalline metal sheet has a tensile strength in the range of about 1.7 to 6.9 GPa.

8. The process according to claim 1 wherein said liquid metallic glass forming alloy has a liquid melt viscosity below about 1.5 mPa-s when said liquid metallic glass forming alloy is introduced to said casting rolls.

9. The process according to claim 1 wherein said nano-crystalline metal sheet has a hardness in the range of about 940 $kg/mm^2$ to 2000 $kg/mm^2$.

* * * * *